US010104734B2

(12) United States Patent
Itami et al.

(10) Patent No.: US 10,104,734 B2
(45) Date of Patent: Oct. 16, 2018

(54) LIGHTING SYSTEM

(71) Applicant: Toshiba Lighting & Technology Corporation, Yokosuka-shi, Kanagawa-ken (JP)

(72) Inventors: Kazuaki Itami, Yokosuka (JP); Hirokazu Otake, Yokosuka (JP)

(73) Assignee: Toshiba Lighting & Technology Corporation, Yokosuka-shi, Kanagawa-ken (JP)

( * ) Notice: Subject to any disclaimer, the term of this patent is extended or adjusted under 35 U.S.C. 154(b) by 0 days.

(21) Appl. No.: 15/698,803

(22) Filed: Sep. 8, 2017

(65) Prior Publication Data

US 2018/0249541 A1 Aug. 30, 2018

(30) Foreign Application Priority Data

Feb. 28, 2017 (JP) ..... 2017-036968

(51) Int. Cl.
*H05B 37/02* (2006.01)
*H05B 33/08* (2006.01)

(52) U.S. Cl.
CPC ..... *H05B 33/0845* (2013.01); *H05B 33/0809* (2013.01)

(58) Field of Classification Search
CPC ..... H05B 33/0803; H05B 33/0827; H05B 33/0809; H05B 33/0821; H05B 41/34; H05B 39/09; H05B 41/28; H05B 33/0815; H05B 33/0818; H05B 41/2828; H05B 41/3921; H05B 41/3927; F21Y 2101/02; B23K 9/0732; B23K 9/1012; B23K 9/1031; B23K 9/1087; G09G 3/2014
See application file for complete search history.

(56) References Cited

U.S. PATENT DOCUMENTS

| | | | | |
|---|---|---|---|---|
| 8,466,631 | B1 | 6/2013 | Rhodes et al. | |
| 2016/0165691 | A1 | 6/2016 | Fassbender et al. | |
| 2016/0366737 | A1* | 12/2016 | Hong | H05B 33/0815 |
| 2016/0381748 | A1* | 12/2016 | Hagino | H05B 33/0815 315/186 |
| 2017/0019968 | A1* | 1/2017 | Song | H05B 33/0827 |

FOREIGN PATENT DOCUMENTS

| | | |
|---|---|---|
| EP | 0375289 A2 | 6/1990 |
| JP | 5058778 B2 | 10/2012 |

OTHER PUBLICATIONS

May 3, 2018—(EP) Extended European Search Report—App 17190785.0.

* cited by examiner

*Primary Examiner* — Minh D A
(74) *Attorney, Agent, or Firm* — Banner & Witcoff, Ltd.

(57) ABSTRACT

Provided is a lighting system including a dimming control device that is arranged apart from a lighting device and outputs a DC voltage of a voltage value corresponding to a dimming degree indicating a turn-on state of a light source of the lighting device, in which the DC voltage is for controlling to turn on the light source in the lighting device, a wiring that transmits the DC voltage output by the dimming control device to the lighting device, and the lighting device that performs absorption control of absorbing a drop in the voltage value due to transmission of the DC voltage by the wiring.

6 Claims, 5 Drawing Sheets

LIGHTING SYSTEM

CROSS-REFERENCE TO RELATED APPLICATIONS

This application is based upon and claims the benefit of priority from Japanese Patent Application No. 2017-036968, filed Feb. 28, 2017, the entire contents of which are incorporated herein by reference.

FIELD

An embodiment described herein relate generally to a lighting system

BACKGROUND

In recent years, there is a need to replace a lighting device such as an incandescent bulb which performs dimming by AC phase control from a dimming control device to a light emitting diode (LED) device. However, when the lighting device is changed to an LED device and turned on by the AC phase control from the dimming control device, there is concern that flickering may occur due to the fluctuation of AC voltage or malfunction of the dimming control device due to load. In view of this problem, there is known a technique using an LED device which is an LED device driven by DC power supplied from a dimming control device and turned on at a dimming degree corresponding to a value of a DC voltage.

However, in the above-mentioned LED device, a voltage drop occurs depending on a wiring length between the dimming control device and the LED device or a wiring diameter, the number of the LED devices connected to a wiring, and the like, thus appropriate control is difficult.

DESCRIPTION OF EMBODIMENTS

Figure 1:
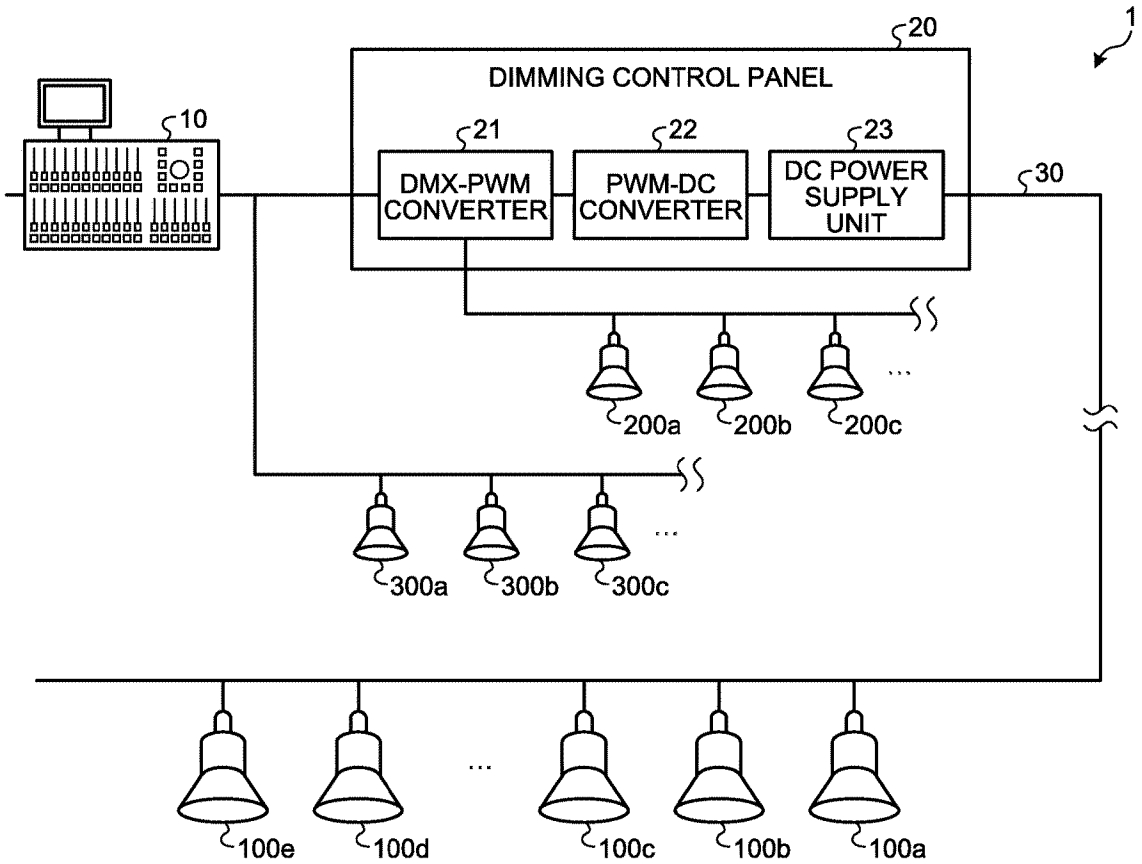
FIG. 1 is a diagram showing an example of a lighting system according to a first embodiment.

Hereinafter, a lighting system according to embodiments will be described with reference to the drawings. In the embodiments, the same reference numerals are given to the configurations having the same functions, and redundant explanations will be omitted. The lighting system described in the following embodiment merely shows one example and does not limit the embodiment. For example, in the following embodiments, the lighting system is assumed to be installed in various facilities such as a theater, a movie theater, and the like. In addition to these facilities, the lighting system may be installed in public facilities such as a public hall or any other facilities such as buildings. Each of the following embodiments may be appropriately combined within a range not inconsistent.

A lighting system 1 according to the following embodiments includes a dimming control device (for example, a dimming control panel 20) that is arranged apart from lighting devices 100*a* to 100*e* (hereinafter, sometimes collectively referred to as an "lighting device 100") and outputs a DC voltage of a voltage value corresponding to a dimming degree indicating a turn-on state of a light source (for example, a light source unit 104) of the lighting device 100, in which the DC voltage is for controlling to turn on the light source in the lighting device 100, a wiring 30 that transmits the DC voltage output by the dimming control device to the lighting device 100, and the lighting device 100 that performs absorption control to absorb a drop in the voltage value due to transmission of the DC voltage by the wiring 30.

In addition, in the lighting system 1 according to the following embodiment, the lighting device 100 performs control to keep the dimming degree at a maximum when the voltage value falls within a predetermined range as absorption control.

In addition, in the lighting system 1 according to the following embodiment, the lighting device 100 performs control of keeping the dimming degree to the maximum when the voltage value falls within a range of values corresponding to at least one of the number of lighting devices 100 connected to the wiring 30, a wiring length between the dimming control device and the lighting device 100, or a thickness of the wiring, as within the predetermined range.

In addition, in the lighting system 1 according to the following embodiment, as the voltage value increases, the dimming degree is increased.

In addition, in the lighting system 1 according to the following embodiment, the lighting device 100 performs control to set the dimming degree to zero when the voltage value is lower than a predetermined threshold value.

In addition, in the lighting system 1 according to the following embodiment, when receiving a signal indicating the dimming degree from a lighting control device 10 that receives an operation from an operator, the dimming control device outputs the DC voltage of the voltage value indicating the dimming degree.

In addition, in the lighting system 1 according to the following embodiment, a plurality of lighting devices 100 are connected to the wiring 30.

Embodiment

Overview of Lighting System

Hereinafter, an example of the lighting system 1 will be described. FIG. 1 is a diagram showing an example of a lighting system according to a first embodiment. In the example shown in FIG. 1, the lighting system 1 includes the dimming control panel 20, the wiring 30, and a plurality of lighting devices 100, 200*a* to 200*c*, and 300*a* to 300*c*. Any number of dimming control panels 20 and lighting devices 100 may be connected to the lighting system 1. In addition, in the example shown in FIG. 1, an example in which the lighting control device 10 is connected to the dimming control panel 20 included in the lighting system 1 is described. Here, the lighting control device 10 may be included in the lighting system 1 or not included.

First, the lighting devices 100, 200*a* to 200*c*, and 300*a* to 300*c* will be described. The lighting device 100 is a lighting device driven by DC power supplied via the wiring 30. For example, the lighting device 100 includes a semiconductor light emitting element such as light emitting diodes (LED) and performs illumination at a predetermined position by turning on the semiconductor light emitting element at the dimming degree corresponding to the voltage value of the supplied DC power with the DC power supplied via the wiring 30 as a driving source. For example, the lighting device 100 is a lighting device for illuminating a seat, a corridor, a guiding light, an entrance, and the like in a stage facility or the like, more specifically, is an LED lamp mounted on a lighting device for illuminating any position other than the stage, such as a chandelier set up in a stage facility.

The lighting devices 200*a* to 200*c* (hereinafter, collectively referred to as an "lighting device 200") are lighting devices based on a pulse width modulation (PWM) signal, and illumination fixtures for general facilities are representative thereof.

The lighting devices 300*a* to 300*c* (hereinafter, collectively referred to as an "lighting device 300") are lighting devices capable of controlling an intensity (that is, a dimming degree) of light to be output by DMX standard, a DMX signal, and a remote device management (RDM) signal conforming to RDM standard and color of the light to be output, for example, are lighting devices that illuminate the stage with a semiconductor light emitting element such as an LED.

The lighting control device 10 is realized by a device called a dimming control console or a control console and controls the lighting device 100 based on an operation by the operator. For example, the lighting control device 10 includes an operation unit such as a preset fader, a fader, a button, and the like and receives control of the dimming degree and color of lighting devices 100 to 300 from a user via the operation unit. In such a case, the lighting control device 10 controls the lighting devices 100 to 300 by outputting the DMX signal indicating the contents of control directly or via the dimming control panel 20. For example, when receiving control of the dimming degree of the lighting device 100 or the lighting device 200, the lighting control device 10 outputs a DMX signal indicating the contents of control to the dimming control panel 20, and when receiving control of the dimming degree or color of the lighting device 300, the lighting control device 10 outputs a DMX signal indicating the contents of control to the lighting device 300.

The dimming control panel 20 is a device that performs dimming control of the lighting devices 100 and 200 based on the DMX signal and is realized by, for example, a distribution board or the like arranged apart from the lighting device 100. For example, the dimming control panel 20 includes a DMX-PWM converter 21, a PWM-direct current (DC) converter 22, and a DC power supply unit 23. When receiving the DMX signal indicating the dimming degree of the lighting device 100 from the lighting control device 10, the DMX-PWM converter 21 generates a PWM signal for turning on the lighting device on which the AC phase control is performed at the dimming degree indicated by the DMX signal and outputs the generated PWM signal to the PWM-DC converter 22. On the other hand, when receiving the DMX signal indicating the dimming degree of the lighting device 200 from the lighting control device 10, the DMX-PWM converter 21 generates a PWM signal for turning on the lighting device on which the AC phase control is performed at the dimming degree indicated by the DMX signal and outputs the generated PWM signal to the lighting device 200. As a result, the dimming control panel 20 may turn on the lighting device 200 at the dimming degree indicated by the DMX signal.

On the other hand, when receiving the PWM signal from the DMX-PWM converter 21, the PWM-DC converter 22 instructs the DC power supply unit 23 to output a DC voltage for turning on the lighting device 100 at the dimming degree indicated by the PWM signal. Then, the DC power supply unit 23 outputs the DC voltage to the wiring 30 and drives the lighting device 100 by applying the DC voltage instructed from the PWM-DC converter 22 to the wiring 30. That is, when receiving a signal indicating the dimming degree from a lighting control device 10 that receives an operation from the operator, the dimming control panel 20 outputs the DC voltage of the voltage value indicating the dimming degree.

The wiring 30 is a wiring that transmits DC power from the dimming control panel 20 to the lighting device 100. For example, in the facility where the lighting system 1 is installed, the wiring 30 is realized by a power supply wire extending from the dimming control panel 20 to an installation position where each lighting device 100 is installed and a power supply wire returning from the installation position to the dimming control panel 20.

About Dimming Control in Related Art

Here, in the lighting system in the related art, there is a case where AC phase control is performed to control a lighting device installed in a facility by two-wire phase control. For example, in facilities such as a stage, a lighting device that changes a dimming degree without changing color, such as a lighting device corresponding to the lighting device 100, an incandescent bulb installed in a ceiling of a seat or an entrance, and the like is controlled by AC phase control. In recent years, with the spread of lighting devices (hereinafter, sometimes referred to as an "LED device") using semiconductor light emitting elements, there is a demand to change lighting devices such as an incandescent bulb to LED devices.

However, when the LED device is controlled by using the AC phase control of the related art, there is concern that flickering may occur due to a change in the AC voltage. In addition, when the LED device is controlled by using the AC phase control of the related art, there is concern that dependency with respect to dimming operation deteriorates and accurate dimming control becomes difficult. On the other hand, in order to replace the lighting system for two-wire phase control to the lighting system for an LED device, there is concern that a new design and replacement of a facility occur, which may lead to a prolonged construction period and increased cost. In addition, depending on the facility, there is a case where the lighting system is installed in historical and symbolic equipment, and exchange of the lighting system is difficult.

Therefore, in the installed lighting system, a method for controlling the LED device is considered by supplying DC power to drive the LED device and fluctuating the voltage according to the dimming degree. However, with such a technique of the related art, there is concern that the LED device may not be appropriately controlled because a voltage drop occurs depending on the wiring length between the dimming control device and the LED device, the wiring diameter, the number of LED devices connected to the wiring, and the like. In addition, in the technique of the related art, when a filament or a wiring in an incandescent bulb that is improperly installed is disconnected because of a direct current flowing through the wiring, there is concern that arc discharge that is generated when an output closed circuit is opened may continue to occur.

About Dimming Control with Respect to Voltage Drop

Then, the lighting system 1 performs the following dimming control with respect to the voltage drop. For example, the dimming control panel 20 outputs a DC voltage of a voltage value corresponding to the dimming degree indicating the turn-on state of the light source of the lighting device 100, which is a DC voltage of a voltage value corresponding to the dimming degree of the light output to the lighting device 100, that is, a DC voltage for controlling to turn on the light source in the lighting device. On the other hand, the lighting device 100 performs absorption control for absorbing a drop in the voltage value due to transmission by the wiring 30. More specifically, as the absorption control, the lighting device 100 keeps the dimming degree at the maximum (for example, 100%) when the voltage value falls within the predetermined range. Such a voltage value range is set according to at least one of various factors that cause a voltage drop when a direct current is passed through the wiring 30 among the lighting devices 100*a* to 100*e* connected to the wiring 30, for example, a wiring length between the lighting device 100*e* having the longest wiring length from the dimming control panel 20 and the dimming control panel 20, a wiring length between the lighting device 100*a* and the dimming control panel 20, a wiring diameter of the wiring 30, and a material of the wiring 30, and the like. In addition, such a setting is assumed to be set in advance for the lighting device 100.

For example, in the example shown in FIG. 1, it is assumed that the dimming control panel 20 applies a DC voltage of DC 82 volts (V) to the wiring 30 which is a two-core vinyl insulated vinyl sheathed flat-type (VVF) cable having a diameter of 1.6 mm. For example, when a wiring length from the dimming control panel 20 to the lighting device 100*e* is 50 meters, a wiring length from the lighting device 100*a* with power consumption of 7 W to the lighting device 100*e* is 50 meters, and 24 lighting devices 100 are installed at equal intervals, a voltage of about DC 80.82 V is applied to the lighting device 100*a*. On the other hand, a voltage of DC 80.26 V is applied to the lighting device 100*e* of the last stage. Therefore, for example, when a DC voltage of DC 80.50 V or more is applied to the lighting devices 100*a* to 100*e*, and the lighting devices 100*a* to 100*e* are set to be turned on at a dimming degree of 100%, although the lighting device 100*a* is turned on at a dimming degree of 100%, the lighting device 100*e* is not turned on at a dimming degree of 100%.

Therefore, when the DC voltage falls within the predetermined range, the lighting device 100 is turned on at a dimming degree of 100%. For example, the lighting device 100 is turned off at a voltage of DC 40 V or less and turned on at a dimming degree of 100% in the range of DC 80 V to DC 83 V, and in the range of DC 40 V to DC 80 V, the lighting device 100 is turned on at a dimming degree along a predetermined dimming curve (for example, 2.3 power curve of JATET-A determined by Theater and Entertainment Technology Association, Japan). That is, when the voltage value is lower than DC 40 V, the lighting device 100 sets the dimming degree to zero and controls to increase the dimming degree as the voltage value increases.

On the other hand, when the DMX signal received from the lighting control device 10 indicates a dimming degree of 0%, the dimming control panel 20 applies a DC voltage of DC 40 V or less to the wiring 30, and when the DMX signal indicates a dimming degree of 100%, the dimming control panel 20 applies a DC voltage of DC 83 V to the wiring 30, for example. In addition, the dimming control panel 20 applies a DC voltage of a voltage value along the predetermined dimming curve to the wiring 30 when the DMX signal indicates a value between a dimming degree of 0% to 100%.

As a result of such processing, for example, the lighting device 100 whose wiring distance is short enough to ignore the voltage drop, is turned on at a dimming degree of 100% before the dimming control panel 20 applies a DC voltage of DC 83 V indicating a dimming degree of 100%. In addition, for example, the lighting device 100 whose voltage drop becomes 2 V is turned on at a dimming degree of 100% when the dimming control panel 20 applies a DC voltage of DC 83 V indicating a dimming degree of 100%. As a result, the lighting system 1 may turn on all the lighting devices 100 at a dimming degree of 100% when the dimming control panel 20 applies a DC voltage indicating a dimming degree of 100%.

Actually, when the dimming degree of each lighting device 100 gradually approaches 100%, each lighting device 100 is sequentially turned on in increasing order of the wiring distance from the dimming control panel 20 at a dimming degree of 100%, and when the dimming degree of each lighting device 100 is gradually decreased from 100%, each lighting device 100 decreases the dimming degree in decreasing order of the wiring distance from the dimming control panel 20. However, when the dimming degree of each lighting device 100 is close to 100%, since the light intensity as a whole is sufficient, even if some degree of variation occurs in the dimming degree, it does not matter much visually.

On the other hand, when the dimming degree of the lighting device 100 is low, the amount of the direct current flowing through the wiring 30 decreases, thus the voltage drop caused by the wiring 30 also decreases, resulting in less variation in brightness. As a result, immediately before each lighting device 100 is turned off, the influence of the voltage drop caused by the wiring 30 is in a negligible range, thus the timing of each lighting device 100 being turned off may be made uniform.

About Dimming Control for Arc Discharge

In addition, the lighting system 1 performs the following dimming control on the arc discharge generated when the output closed circuit is opened. For example, when the voltage value of the DC voltage transmitted by the wiring 30 instead of the DC voltage value output from the dimming control panel 20 unintentionally decreases, that is, when the voltage value of the DC voltage transmitted through the wiring 30 decreases, the lighting device 100 installed in the lighting system 1 decreases the dimming degree of the output light. As a result, the current value of the direct current flowing through the wiring 30 decreases. For example, the lighting device 100 increases the dimming degree with respect to the DC voltage when the value of the DC voltage gradually increases from DC 40 V to DC 80 V.

When such control is performed, when the voltage value of the DC power supply applied with the dimming degree being high to some extent decreases, since the power consumption is reduced by decreasing the dimming degree, the lighting device 100 reduces the amount of the direct current flowing through the wiring 30. In this manner, in the lighting device 100, the amount of the direct current flowing through the wiring 30 has a positive characteristic with respect to the DC voltage supplied through the wiring 30.

Figure 5:
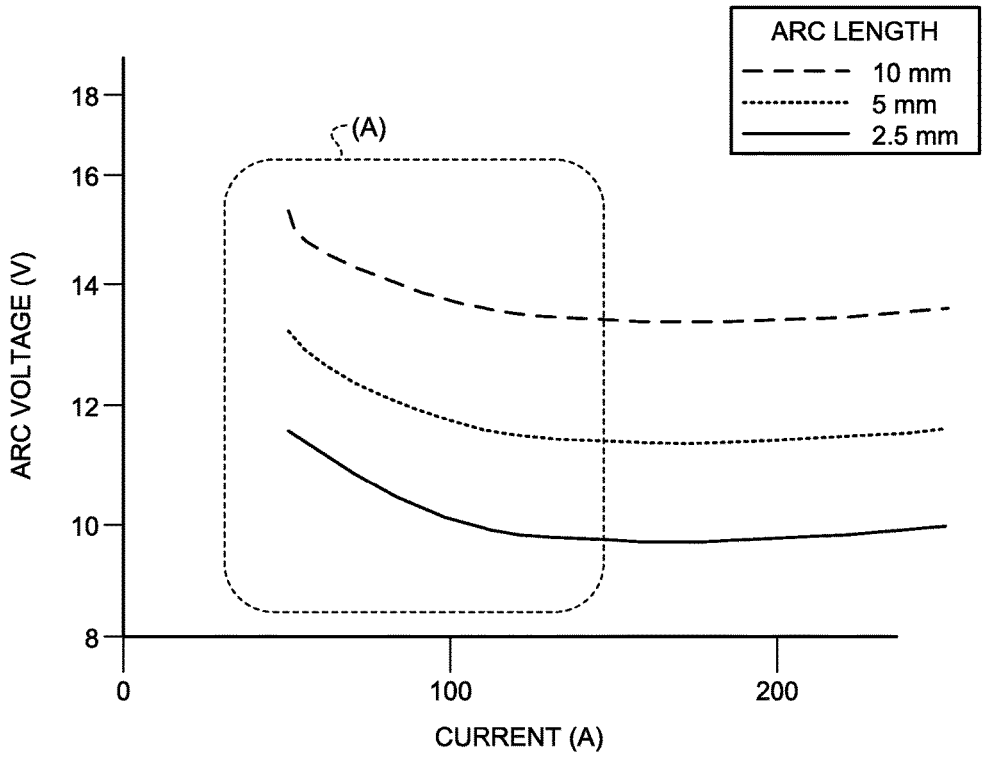
FIG. 5 is a diagram showing a relationship between a current value and a voltage value when arc discharge is continuously generated.

As shown in FIG. 5, arc discharge is known to show negative voltage-current characteristics in a region of about 100 A or less. When the above-described control is performed, the lighting device 100 reduces the light output as the voltage applied to the lighting device 100 decreases by the discharge voltage when arc discharge occurs when an output load wiring is opened due to disconnection or the like. As a result of such control, the amount of direct current flowing through the wiring 30 also decreases. When the discharge current decreases, the discharge voltage increases, thus a positive feedback that the voltage applied to the lighting device 100 further decreases, and the current flowing through the wiring 30 further decreases occurs. As a result, the arc discharge generated disappears finally. In this manner, the lighting device 100 may prevent arc discharge from continuing.

If the dimming degree is controlled so that the amount of the direct current flowing through the wiring 30 has a positive characteristic with respect to the DC voltage supplied through the wiring 30, the lighting device 100 may not have to control the dimming degree to be increased exponentially with respect to the DC voltage. For example, the lighting device 100 may control the dimming degree to be proportional to the DC voltage. Even in such a case, when the value of DC voltage decreases due to arc discharge, the lighting device 100 decreases the dimming degree and reduces the amount of the direct current flowing through the wiring 30, thus preventing arc discharge from continuing.

In addition, when such control is performed, among the lighting devices 100, a point where arc discharge occurs, that is, the lighting device 100 whose wiring distance from the dimming control panel 20 is farther than the disconnection point changes the dimming degree. As a result, it is possible to easily identify the disconnection point.

About Functional Configuration of Lighting System

Figure 2:
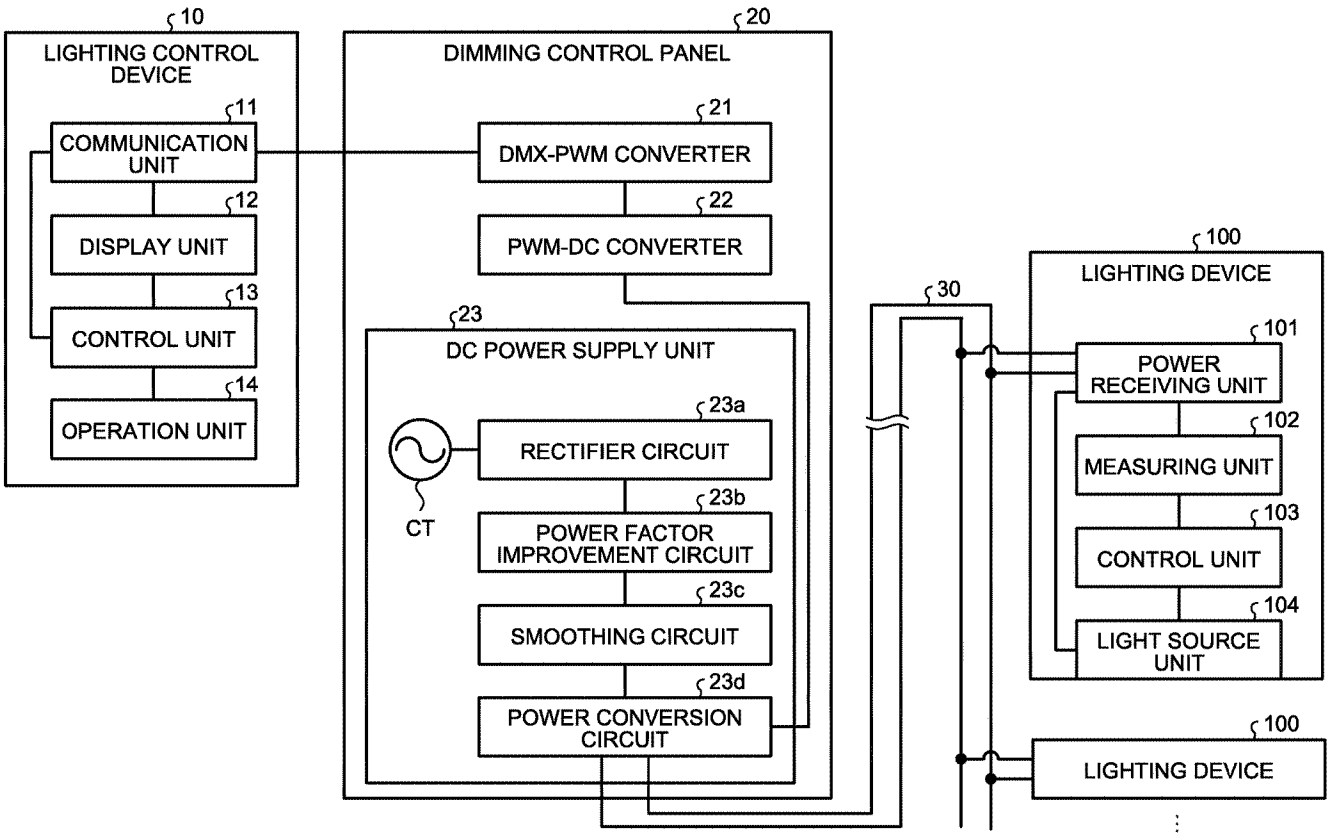
FIG. 2 is a diagram showing an example of a functional configuration of the lighting system according to the embodiment.

Hereinafter, an example of the functional configuration of the lighting system 1 that serves the above-described functions will be described with reference to FIG. 2. FIG. 2 is a diagram showing an example of a functional configuration of the lighting system according to the embodiment. In the example shown in FIG. 2, an example of the functional configuration of the lighting control device 10 is described together with the functional configuration of the dimming control panel 20, the wiring 30 and the lighting device 100 constituting the lighting system 1. In addition, in the example shown in FIG. 2, the illustration of the lighting devices 200 and 300 is omitted. In addition, in the following description, the function that the lighting system 1 serves when controlling the lighting device 100 will be described, and the description of the function when controlling the lighting devices 200 and 300 will be omitted.

First, an example of the functional configuration of the lighting control device 10 will be described. In the example shown in FIG. 2, the lighting control device 10 includes a communication unit 11, a display unit 12, a control unit 13, and an operation unit 14. The communication unit 11 is, for example, a communication unit that outputs a DMX signal to the dimming control panel 20 and is realized by a DMX terminal or the like. This signal may be a digital addressable lighting interface (DALI) or a serial signal.

The display unit 12 is a display device for displaying various information relating to the dimming control and is realized by, for example, a liquid crystal panel or the like. For example, under the control of the control unit 13, the display unit 12 displays the dimming degree of various lighting devices included by the lighting system 1, the correspondence between each lighting device and the fader, and the like.

The control unit 13 is an arithmetic unit that executes various types of information processing and may adopt, for example, electronic circuits such as a central processing unit (CPU) and a micro processing unit (MPU), and integrated circuits such as an application specific integrated circuit (ASIC), and a field programmable gate array (FPGA). For example, when the operator changes the dimming degree of the lighting device 100 by operating the operation unit 14 corresponding to the lighting device 100, the control unit 13 outputs the DMX signal indicating the dimming degree after the change to the dimming control panel 20 via the communication unit 11.

The operation unit 14 is a control device that receives control over various lighting devices, such as control of the dimming degree and is realized by, for example, a fader or the like.

Next, an example of the functional configuration of the dimming control panel 20 will be described. The dimming control panel 20 includes a DMX-PWM converter 21, a PWM-DC converter 22, and a DC power supply unit 23. In addition, the DC power supply unit 23 includes a system power supply CT, a rectifier circuit 23*a*, a power factor improvement circuit 23*b*, a smoothing circuit 23*c*, and a power conversion circuit 23*d*.

When receiving the DMX signal from the lighting control device 10, the DMX-PWM converter 21 converts the received DMX signal into a PWM signal. More specifically, when receiving the DMX signal indicating the dimming degree of the lighting device 100, the DMX-PWM converter 21 outputs a PWM signal of a predetermined waveform corresponding to the dimming degree indicated by the DMX signal.

When receiving the PWM signal, the PWM-DC converter 22 instructs the DC power supply unit 23 to apply a DC voltage for turning on the lighting device 100 at the dimming degree indicated by the PWM signal to the wiring 30. For example, the PWM-DC converter 22 generates a dimming signal Sd indicating the dimming degree from the PWM signal and inputs the generated dimming signal Sd to the power conversion circuit 23*d* included in the DC power supply unit 23.

The DC power supply unit 23 applies a DC voltage for turning on the lighting device 100 at the dimming degree indicated by the dimming signal Sd to the wiring 30. Hereinafter, the functions of the circuits 23*a* to 23*d* of the DC power supply unit 23 will be described.

For example, the rectifier circuit 23*a* rectifies the AC voltage supplied from the system power supply CT and converts the AC voltage into an AC voltage of a pulsating current. For example, the rectifier circuit 23*a* is, for example, a full-wave rectifier circuit and is configured by a diode bridge. The power factor improvement circuit 23*b* is a circuit that converts the AC voltage of the pulsating current output from the rectifier circuit 23*a* into a DC voltage and outputs the DC voltage and is realized by, for example, a step-up power supply circuit, a step-up/step-down power supply circuit, a step-down power supply circuit, and the like. Such a power factor improvement circuit 23*b* may reduce the distortion of the input current waveform and suppress harmonics.

The smoothing circuit 23*c* is a smoothing circuit that absorbs the fluctuation of the input current and supplies a stabilized DC voltage to the power conversion circuit 23*d* in a subsequent stage and is realized by a smoothing capacitor such as an electrolytic capacitor or the like. The smoothing circuit 23*c* may be a circuit in which a capacitor capable of absorbing a high-frequency noise such as a film capacitor or a ceramic capacitor is installed in parallel with a parallel capacitor.

The power conversion circuit 23*d* converts the DC voltage supplied via the smoothing circuit 23*c* into a DC voltage having a voltage value indicated by the dimming signal Sd supplied from the PWM-DC converter 22. For example, the power conversion circuit 23*d* generates a DC voltage indicated by the dimming signal Sd and applies the generated DC voltage to the wiring 30. In this manner, since the DC power supply unit 23 rectifies the AC voltage supplied from the system power supply CT, converts the AC voltage into a DC voltage, converts the converted DC voltage to a DC voltage indicated by dimming signal Sd, and then applies the DC voltage to the wiring 30, it is possible to apply the rectified DC voltage.

Next, an example of the functional configuration included in the lighting device 100 will be described. The lighting device 100 includes a power receiving unit 101, a measuring unit 102, a control unit 103, and the light source unit 104. The power receiving unit 101 receives the DC power supplied via the wiring 30. The measuring unit 102 measures the DC voltage value received by the power receiving unit 101 at predetermined time intervals. Then, the control unit 103 controls the light source unit 104 to be turned on at a dimming degree corresponding to the DC voltage value measured by the measuring unit 102. The light source unit 104 is a semiconductor light emitting element such as an LED that is turned on by using a direct current based on a voltage value received by the power receiving unit 101.

Here, when the voltage value of the DC voltage input to the lighting device 100 fluctuates temporally due to ripple, noise, or the like, there is a concern of setting a dimming degree according to the timing at which the DC voltage is acquired. Therefore, the lighting device 100 may have a function of suppressing the temporal fluctuation of the DC voltage. For example, the control unit 103 stores a digital value of the DC voltage measured by the measuring unit 102 at a predetermined sampling period in a predetermined storage device such as a flash memory. Then, the control unit 103 averages the digital values stored in the storage device by a well-known averaging algorithm and adopts the averaged value as the voltage value of the DC voltage. Then, the control unit 103 controls the light source unit 104 to be turned on at a dimming degree corresponding to the adopted voltage value. By such averaging processing, the lighting device 100 may suppress the influence of fluctuation of the DC voltage value caused by ripple, noise, or the like.

The value of the sampling period is set to an appropriate value in advance. In addition, the number of data used in the averaging processing or the value of an averaging period is set to an appropriate value in advance. These values may be replaced with more appropriate values depending on the result of the averaging processing and the facility, the length of the wiring 30, and the like at which the lighting system 1 is installed.

About Example of Dimming Control

Figure 3:
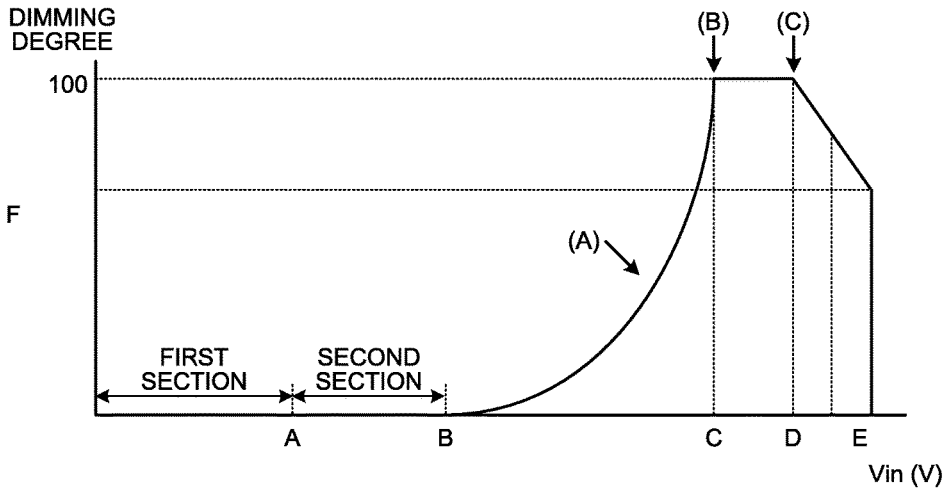
FIG. 3 is a diagram for explaining an example of a dimming degree set by a lighting device according to the embodiment.

Next, an example of the dimming degree set by the lighting device 100 according to the DC voltage value will be described with reference to FIG. 3. FIG. 3 is a diagram for explaining an example of a dimming degree set by a lighting device according to the embodiment. In the example shown in FIG. 3, a voltage value Vin (V) of the DC voltage measured by the lighting device 100 is plotted on the horizontal axis and the dimming degree (%) set by the lighting device 100 is plotted on the vertical axis, and the relationship between the voltage value Vin and dimming degree is plotted.

For example, in the example shown in FIG. 3, a range of the voltage value Vin from "0 volts" to "A volts (for example, 25 volts)" is set as a first section in which the dimming degree is kept at "0%". This first section corresponds to a section in which the DMX signal is not input to the dimming control panel 20. In addition, in the example shown in FIG. 3, a range from "A volts" to "B volts (for example, 40 volts)" is set as a second section. In the second section, the dimming control panel 20 outputs a PWM signal, but the signal corresponds to a turn-off PWM output section in which the dimming degree of the lighting device 100 is kept at "0%".

That is, the lighting device 100 sets an idle section in which the DC voltage is applied to the wiring 30 by the dimming control panel 20 but the dimming degree is kept at "0 percent". Then, as shown in (A) of FIG. 3, the lighting device 100 increases the dimming degree exponentially with respect to the voltage value Vin in the range where the voltage value Vin is "B volts" or more to "C volts (for example, 80 volts)". As a result, the lighting device 100 may make the dimming degree follow the operation of quickly increasing the dimming degree from the "0%" state.

For example, because power for driving is not supplied when the voltage value Vin is "0 volts", the lighting device 100 may not make the dimming degree follow the operation rapidly even if the value of the voltage value Vin is increased quickly. However, in the second section, the lighting device 100 controls the idling state to keep the dimming degree at zero while DC power is supplied. Therefore, the lighting device 100 may make the dimming degree follow the operation even when the value of the voltage value Vin increases from the second section. In the example shown in FIG. 3, the lighting device 100 controls so that the dimming degree is increased exponentially with respect to the value of the voltage value Vin. Such dimming degree control is control based on the relationship between the dimming operation and human visibility. That is, the lighting device 100 gently changes the light output with respect to a change in the dimming degree because the human visibility is sensitive in a region where the light output is low. In addition, since the human visibility becomes insensitive in a region where the light output is high, the lighting device 100 may set so that the dimming operation and the sense of brightness seen by a human are substantially proportional by changing the light output more quickly according to a change in the dimming degree.

In addition, as shown in (B) and (C) of FIG. 3, in the lighting device 100, a range where the voltage value Vin ranges from "C volts" to "D volts (for example, 85 volts)" is set as a fully-lighted section in which the dimming degree is kept at "100%". By providing such a fully-lighted section, the lighting system 1 may keep the plurality of the lighting devices 100 in a fully-lighted state even when the voltage drop due to the wiring 30 occurs.

For example, when the operator wants to turn on all the lighting devices 100*a* to 100*e* in the fully-lighted state, the dimming control panel 20 applies a DC voltage to the wiring 30 so that a DC voltage of "C volts" or more is applied to the lighting device 100*e* having the longest wiring distance, and a DC voltage of "D volts" or less is applied to the lighting device 100*a* having the shortest wiring distance. As a result, the voltage values Vin measured by all the lighting devices 100*a* to 100*e* fall within the range of "C volts" or more and "D volts" or less, thus all the lighting devices 100*a* to 100*e* may perform illumination in the fully-lighted state.

By changing the settings of "C Volt" and "D Volt" shown in FIG. 1, the lighting system 1 may set the plurality of the lighting devices 100 installed in any facility to be in the fully-lighted state appropriately. For example, the lighting system 1 may set the plurality of the lighting devices 100 to be in the fully-lighted state appropriately by increasing the interval from "C volts" to "D volts" as the wiring length between the lighting device 100*a* having the shortest wiring length from the dimming control panel 20 and the lighting device 100*e* having the longest wiring length from the dimming control panel 20 becomes longer and the thickness of the wiring becomes thinner or as the number of lighting devices 100*a* to 100*e* increases.

In addition, the lighting device 100 aims to protect from overvoltage, and when the voltage value Vin becomes "D" volts or more, the voltage value is gradually decreased with respect to the increase of the voltage value Vin. Then, when the voltage value Vin becomes "E" volts, the lighting device 100 decreases the dimming degree to "F% (for example, about 67%)" lower than "100%", and when the voltage value Vin exceeds "E", the lighting device 100 sets the dimming degree to be "0%".

About Prevention of Arc Discharge Continuation

Figure 4:
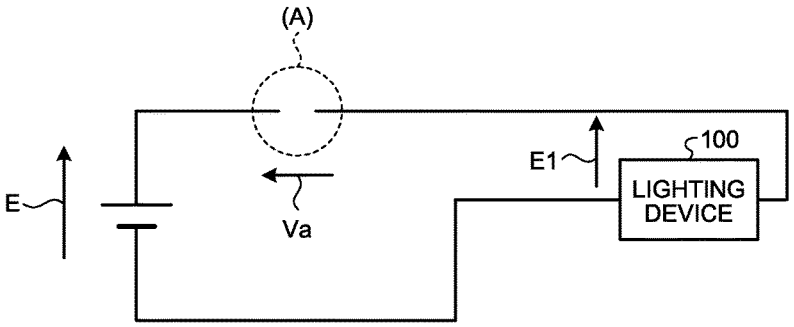
FIG. 4 is a diagram schematically showing a wiring of the lighting system according to the embodiment.

For example, FIG. 4 is a diagram schematically showing the wiring of the lighting system according to the embodiment. For example, when there is no disconnection on the wiring 30, a DC voltage E applied by the dimming control panel 20 and a DC voltage E1 applied to the lighting device 100 have the same value. On the other hand, as shown in (A) of FIG. 4, when a disconnection occurs on the wiring 30, a voltage Va is generated. Therefore, the DC voltage E1 applied to the lighting device 100 becomes a value obtained by subtracting the DC voltage Va from the DC voltage E.

Here, as shown in FIG. 3, in a range where the voltage value Vin is from "B volts" to "C volts", the lighting device 100 controls the dimming degree so as to increase the dimming degree exponentially with respect to the increase of the voltage value Vin. In the case of performing such control, the lighting device 100 decreases the dimming degree when the value of the DC voltage E1 decreases. As a result, the value of the direct current flowing through the wiring 30 decreases.

Here, FIG. 5 is a diagram showing the relationship between the current value and the voltage value of arc discharge. In the example shown in FIG. 5, the current value (ampere) is plotted on the horizontal axis and the voltage value (volt) of the arc voltage is plotted on the vertical axis, and the relationship between the voltage value and the current value of the arc discharge is plotted for each length (arc length) of the arc discharge. As shown in the range in (A) of FIG. 5, in a range where the current value is less than about 100 amperes, the electrical characteristics of the arc discharge show negative characteristics.

However, in the lighting device 100, since the input voltage decreases due to the generation of an arc voltage when the disconnection occurs, the dimming degree decreases and the current amount of the wiring 30 is reduced. Then, since the arc voltage increases, the dimming degree further decreases, the current of the wiring 30 decreases, the lighting device 100 is finally turned off, and the current of the wiring 30 also decreases, thus the arc discharge disappears. Here, since the DC voltage value applied from the dimming control panel 20 is constant, the arc discharge disappears without continuing. As a result, the lighting device 100 may prevent arc discharge from continuing.

In addition, for example, when the lighting device 100 decreases the dimming degree due to the occurrence of arc discharge and is turned off, it is possible to give the user an indication of where the disconnection has occurred.

About Example of Flow of Dimming Control

Figure 6:
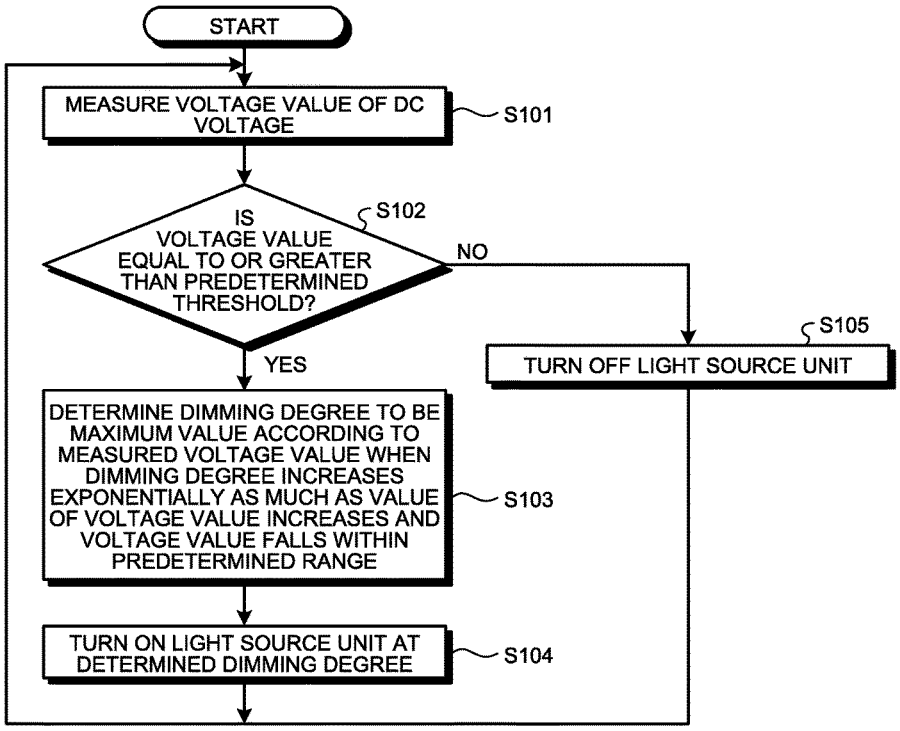
FIG. 6 is a diagram showing an example of a flow of dimming control performed with respect to a voltage drop by the lighting device according to the embodiment.
Figure 7:
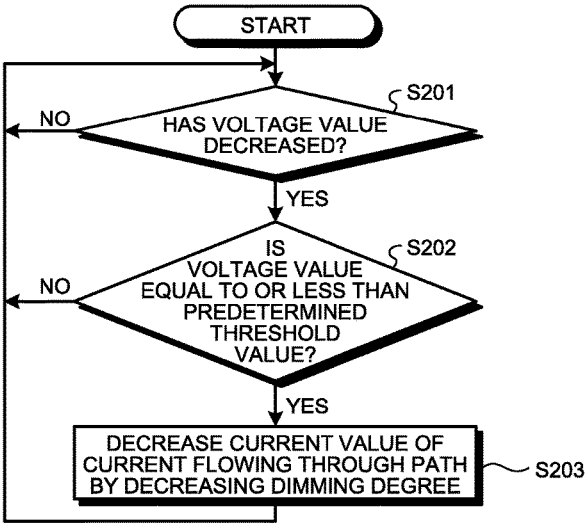
FIG. 7 is a diagram showing an example of a flow of dimming control performed with respect to the arc discharge by the lighting device according to the embodiment.

Next, an example of a flow of dimming control executed by the lighting device 100 according to the embodiment will be described with reference to FIGS. 6 and 7. FIG. 6 is a diagram showing an example of the flow of dimming control performed with respect to a voltage drop by the lighting device according to the embodiment. In addition, FIG. 7 is a diagram showing an example of the flow of dimming control performed with respect to arc discharge by the lighting device according to the embodiment.

First, an example of the flow of dimming control performed with respect to a voltage drop by the lighting device 100 will be described with reference to FIG. 6. For example, the lighting device 100 measures a voltage value of a DC voltage (Act 101). In such a case, the lighting device 100 determines whether or not the voltage value is equal to or greater than a predetermined threshold value (Act 102). Then, when the voltage value is equal to or greater than the predetermined threshold value (Act 102: Yes), the lighting device 100 increases the dimming degree exponentially as much as the value of the voltage value increases, and when the voltage value falls within the predetermined range, the lighting device 100 determines the dimming degree which is the maximum value according to the measured voltage value (Act 103). Thereafter, the lighting device 100 turns on the light source unit 104 at the determined dimming degree (Act 104) and executes Act 101 again. On the other hand, when the voltage value is lower than the predetermined threshold value (Act 105: No), the lighting device 100 turns off the light source unit 104 (Act 105) even if a DC voltage is applied and executes Act 101 again.

Next, an example of the flow of dimming control performed with respect to arc discharge by the lighting device 100 will be described with reference to FIG. 7. First, the lighting device 100 determines whether or not the voltage value has decreased (Act 201), when the lighting device 100 determines that the voltage value has decreased (Act 201: Yes), the lighting device 100 determines whether or not the voltage value is equal to or less than the predetermined threshold value (Act 202). Then, when the lighting device 100 determines that the voltage value is equal to or less than the predetermined threshold value (Act 202: Yes), the lighting device 100 executes Act 201 by decreasing the current value of the current flowing through the path by decreasing the dimming degree (Act 203). On the other hand, when the voltage value has not decreased (Act 201: No) or the voltage value is larger than the predetermined threshold value (Act 202: No), the lighting device 100 executes Act 201.

Modification Example Of Each Embodiment

About Configuration

In each of the embodiments described above, the lighting system 1 includes the lighting device 200 that performs AC phase control and the lighting device 300 that may be directly controlled by a DMX signal. However, the embodiments are not limited thereto. For example, the lighting system 1 may not include the lighting devices 200 and 300. In addition, the lighting system 1 may be a lighting system installed at any facility.

About Dimming Control

In addition, the dimming control executed by the lighting device 100 described above is merely an example, when a DC voltage of some voltage value is applied to the lighting device 100, any settings as to how much dimming degree of illumination is performed are possible. That is, in order to eliminate the variation of the dimming degree due to the voltage drop due to the wiring 30, when the voltage value is within the predetermined range, the lighting device 100 may have any settings as long as illumination is performed at the same dimming degree. In addition, as long as the direct current flowing through the wiring 30 may be reduced by decreasing the dimming degree at the time of the voltage drop, the lighting device 100 may adopt any dimming curve in controlling the dimming degree and perform dimming control at a dimming degree proportional to the voltage value, for example.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

Therefore, exemplary embodiments aim to appropriately control an LED device driven by DC power.

What is claimed is:

1. A lighting system comprising:

a dimming control device that is arranged apart from a lighting device and outputs a DC voltage of a voltage value corresponding to a dimming degree indicating a turn-on state of a light source of the lighting device, in which the DC voltage is for controlling turning on the light source in the lighting device;

a wiring that transmits the DC voltage output by the dimming control device to the lighting device; and the lighting device that performs (a) being turned on at a dimming degree indicated by a value of the DC voltage when the DC voltage is applied, and (b) performing absorption control of keeping the dimming degree to a maximum, even if voltage value falls, when the value of the applied DC voltage is in a range from a first predetermined value to a second predetermined value, to prevent overvoltage.

2. The system according to claim 1, wherein the lighting device performs control of keeping the dimming degree to the maximum when the voltage value falls within a range of values corresponding to at least one of a number of lighting devices connected to the wiring, a wiring length between the dimming control device and the lighting device, or a thickness of the wiring, as within the range from the first predetermined value to the second predetermined value.

3. The system according to claim 1, wherein the lighting device increases dimming degree as the voltage value increases.

4. The system according to claim 1, wherein the lighting device performs control of setting the dimming degree to zero when the voltage value is lower than a predetermined threshold value.

5. The system according to claim 1, wherein the dimming control device outputs a DC voltage of a voltage value indicating the dimming degree when receiving a signal indicating the dimming degree from a lighting control device that receives an operation from an operator.

6. The system according to claim 1, wherein a plurality of the lighting devices is connected to the wiring.

* * * * *